US009211026B1

(12) United States Patent
McLemore

(10) Patent No.: US 9,211,026 B1
(45) Date of Patent: Dec. 15, 2015

(54) ORNAMENT TO TREE TOP ATTACHMENT SYSTEM

(71) Applicant: Pat Dennis McLemore, Las Vegas, NV (US)

(72) Inventor: Pat Dennis McLemore, Las Vegas, NV (US)

( * ) Notice: Subject to any disclaimer, the term of this patent is extended or adjusted under 35 U.S.C. 154(b) by 0 days.

(21) Appl. No.: 14/294,972

(22) Filed: Jun. 3, 2014

Related U.S. Application Data

(60) Provisional application No. 61/830,850, filed on Jun. 4, 2013.

(51) Int. Cl.

| | |
|---|---|
| ***A47F 5/00*** | (2006.01) |
| ***A47G 33/10*** | (2006.01) |
| *A47G 33/08* | (2006.01) |
| *A47G 33/06* | (2006.01) |

(52) U.S. Cl.
CPC ..... *A47G 33/10* (2013.01); *A47G 33/06* (2013.01); *A47G 33/08* (2013.01); *A47G 33/105* (2013.01); *A47G 2033/089* (2013.01)

(58) Field of Classification Search
CPC . A47G 2033/089; A47G 33/08; A47G 33/06; A47G 33/10; A47G 33/105
USPC ..... 248/316.8, 530, 85, 87, 156; 428/7, 19
See application file for complete search history.

(56) References Cited

U.S. PATENT DOCUMENTS

| | | | | |
|---|---|---|---|---|
| 3,317,168 | A * | 5/1967 | Ziph | 248/156 |
| 4,526,819 | A * | 7/1985 | Murray | 428/7 |
| 4,756,936 | A * | 7/1988 | Frank et al. | 428/7 |
| 6,533,140 | B1 * | 3/2003 | Freeman | 220/737 |
| 2008/0017226 | A1 * | 1/2008 | Nobert et al. | 135/16 |

* cited by examiner

*Primary Examiner* — Christopher Garft
(74) *Attorney, Agent, or Firm* — Plager Schack LLP

(57) ABSTRACT

An attachment system is configured to connect a topper ornament to a tree having a center pole attached to branches. The attachment system includes a dome configured to contain a plurality of prongs. A topper receiver post is mechanically coupled to the dome and configured to receive the topper ornament. A tree post is mechanically coupled to the dome and configured to receive the center pole. Inserting the center pole into the tree post causes the branches attached to the center pole to hold the attachment system in place.

2 Claims, 4 Drawing Sheets

ORNAMENT TO TREE TOP ATTACHMENT SYSTEM

RELATED APPLICATION

This application claims priority to provisional patent application U.S. Ser. No. 61/830,850 filed on Jun. 4, 2013, the entire contents of which is herein incorporated by reference.

BACKGROUND

The embodiments herein relate generally to home furnishings and decorations.

Prior to embodiments of the disclosed invention, Christmas tree toppers came with various attachment devices, such as cones and coils in different sizes that did not provide a stable and uniform platform for the tree topper. As a result, many tree toppers fell off or tilted to one side or another. Embodiments of the disclosed invention solve this problem.

SUMMARY

An attachment system is configured to connect a topper ornament to a tree having a center pole attached to branches. The attachment system includes a dome configured to contain a plurality of prongs. A topper receiver post is mechanically coupled to the dome and configured to receive the topper ornament. A tree post is mechanically coupled to the dome and configured to receive the center pole. Inserting the center pole into the tree post causes the branches attached to the center pole to hold the attachment system in place.

In some embodiments, the center pole can be mechanically coupled to a plurality of tree post supports which can be further mechanically coupled to the dome. The tree post supports can prevent plastic deformation of the tree post when the center pole is inserted into the tree post. The plurality of tree post supports further can further include a first tree post support, a second tree post support, a third tree post support and a fourth tree post support. The plurality of prongs can further include a first prong, a second prong, a third prong and a fourth prong. The plurality of tree post supports can be offset from the plurality of prongs to prevent the plastic deformation.

For example, the first tree post support can be located at zero degrees. The second tree post support can be located at 90 degrees. The third tree post support can be located at 180 degrees. The fourth tree post support cab be located at 270 degrees. The first prong can be located at 45 degrees. The second prong can be located at 135 degrees. The third prong can be located at 225 degrees. The fourth prong can be located at 315 degrees.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
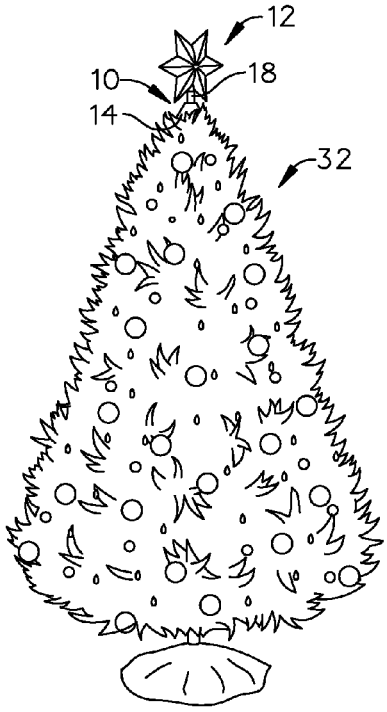
FIG. 1 is a perspective view of an embodiment of the invention, shown in use
Figure 7:
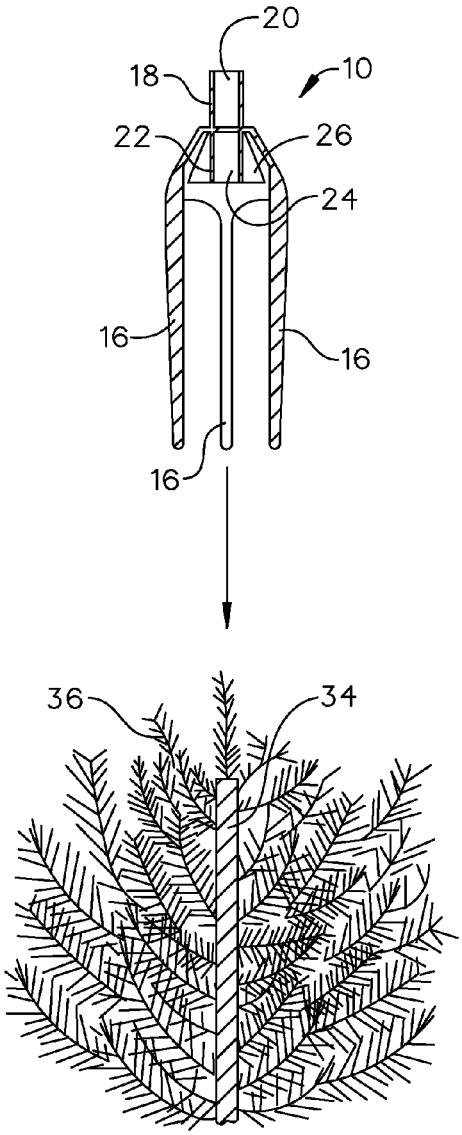
FIG. 7 is a section view of an embodiment of the invention, illustrating the placement of the attachment device onto the tree center post.
Figure 8:
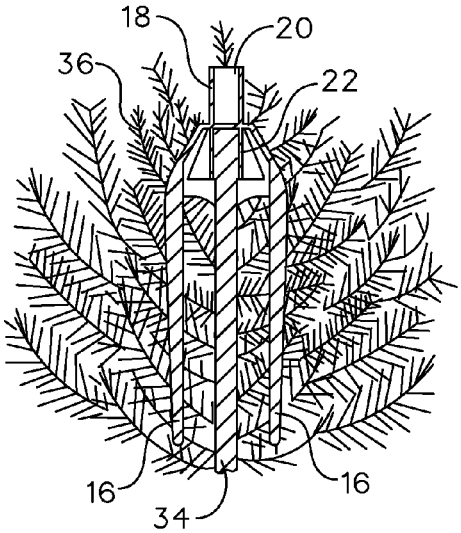
FIG. 8 is a section view of an embodiment of the invention, illustrating the attachment device attached to the tree center post and branches.

By way of example, and referring to FIG. 1, one embodiment of attachment system 10 is configured to support topper ornament 12 atop tree 32. Attachment system 10 is shown in more detail in FIGS. 2-6 below. In FIGS. 7 and 8, tree 32 is an artificial tree having center pole 34 from which braches 36 extend. Embodiments of the disclosed invention could operate equally well with a natural tree, provided that the attachment of braches 36 is substantially similar to tree 32 toward to the top of tree 32.

Figure 2:
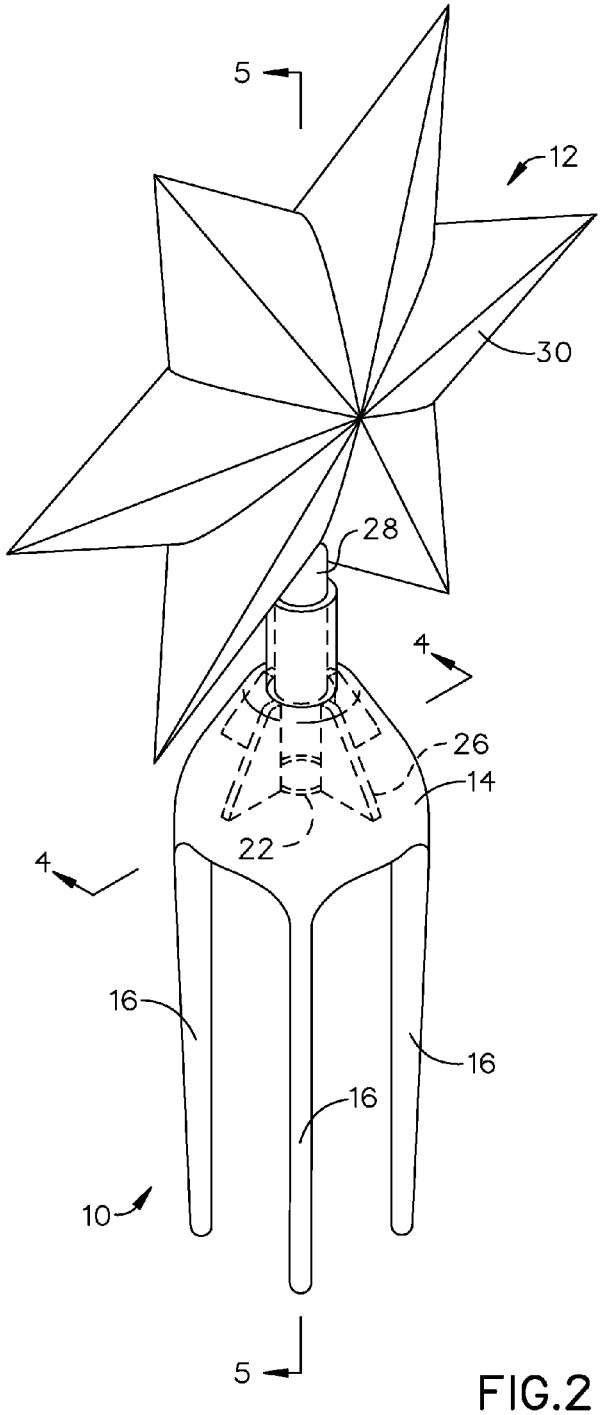
FIG. 2 is a perspective view of an embodiment of the invention with an exemplary ornament
Figure 3:
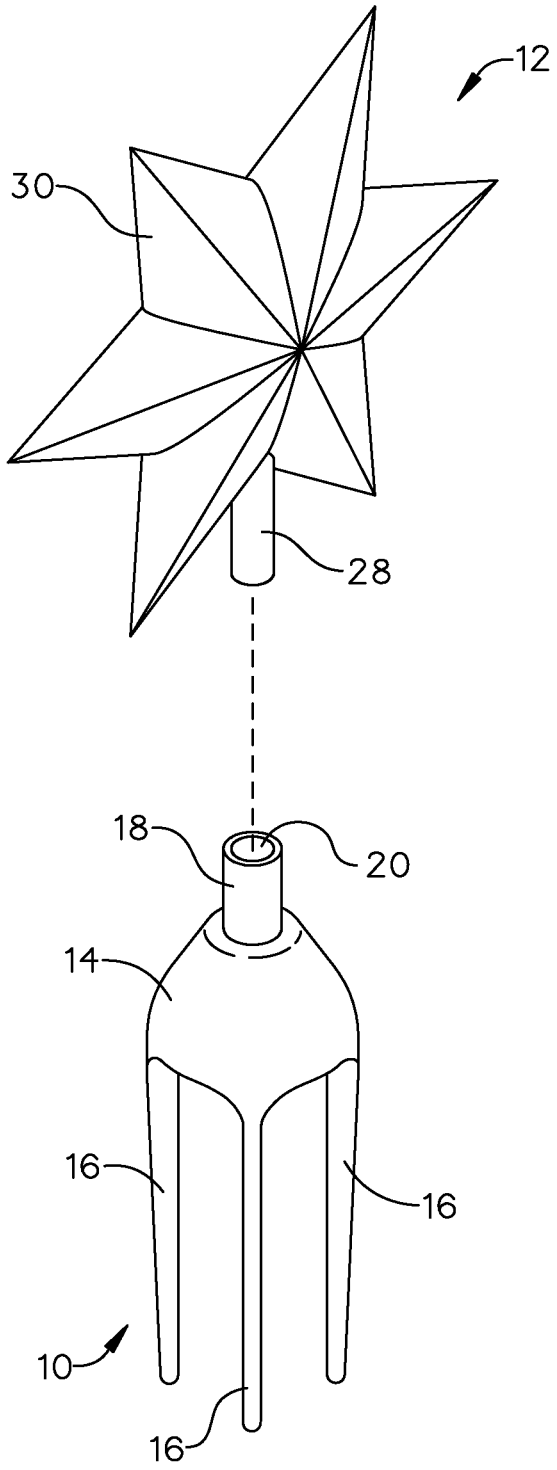
FIG. 3 is an exploded view of an embodiment of the invention

FIG. 2 and FIG. 3, show perspective views of the device in use. Attachment device 10 comprises dome 14 from which first prong 16, second prong 16, third prong 16 and fourth prong 16 extend, which are collectively a plurality of prongs 16. Dome 14 is formed with topper receiver post 18, configured as a cylinder with a single end closed forming upper cavity 20.

Topper ornament 12 further comprises ornament 30 mechanically coupled to topper post 28. Topper post 28 is typically a tube with a sealed end. Topper post 28 can be press fit into upper cavity 20 which attaches topper ornament 12 to attachment device 10.

Dome 16 is mechanically coupled to tree post 22, configured as a cylinder with a single end closed forming lower cavity 24. Tree post 22 is mechanically coupled to first tree post support 26, second tree post support 26, third tree post support 26 and fourth tree post support 26 which are collectively a plurality of tree post supports. Similarly, first tree post support 26, second tree post support 26, third tree post support 26 and fourth tree post support 26 are mechanically coupled to dome 14.

Figure 4:
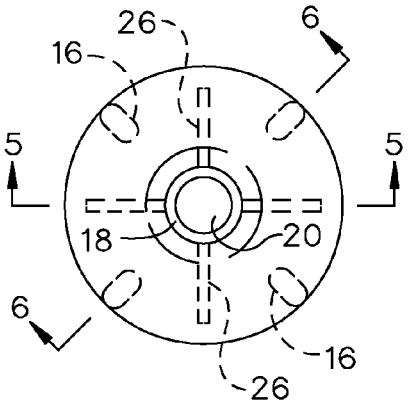
FIG. 4 is a top view of an embodiment of the invention
Figure 5:
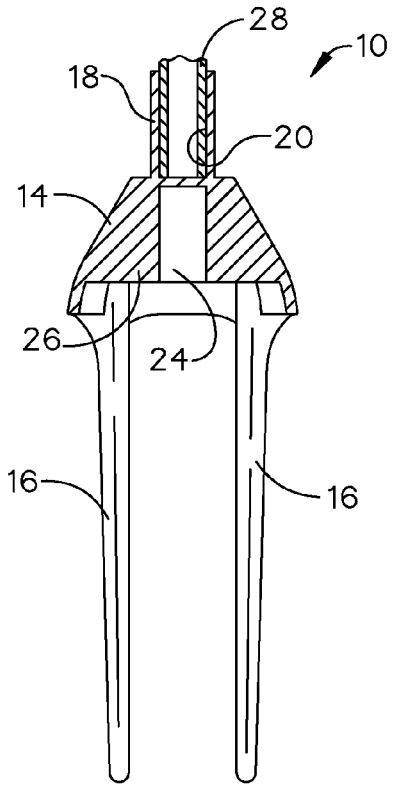
FIG. 5 is a section view of an embodiment of the invention, taken along line 5-5 in FIG. 4.
Figure 6:
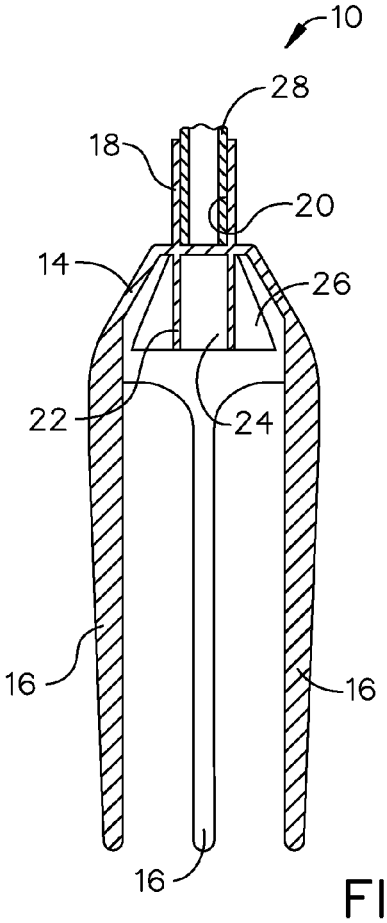
FIG. 6 is a section view of an embodiment of the invention, taken along line 6-6 in FIG. 4.

Turning to FIG. 4, FIG. 5 and FIG. 6, while upper cavity 20 and lower cavity 24 are collinear, the prongs 16 and tree post supports 26 are offset. In particular, first tree post support 26 is located at zero degrees, second tree post support 26 is located at 90 degrees, third tree post support 26 is located at 180 degrees and fourth tree post support 26 is located at 270 degrees. At the same time, first prong 16 is located at 45 degrees, second prong 16 is located at 135 degrees, third prong 16 is located at 225 degrees and fourth prong 16 is located at 315 degrees. This arrangement is uniquely effective for preventing plastic deformation.

FIG. 7 and FIG. 8 demonstrate this resiliency in more detail. The pattern of branches 36 on an artificial tree 32 is known and that pattern will slide around the prongs 16 holding prongs 16 firmly in place. Further, center pole 34 is press fit into lower cavity 24. Now, this procedure could cause some unwanted plastic deformation of tree post 22. However, that risk is effectively eliminated by the use of tree post supports 26 which rigidly hold tree post 24 in place on center pole 32.

Embodiments of the present invention can be made from known materials using known material making techniques. For instance, wood, plastic or metal can be effective in different embodiments depending on personal preference.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. An attachment system, configured to connect a topper ornament to a tree having a center pole attached to branches; the attachment system comprising:

a dome attached to a plurality of prongs; wherein the plurality of prongs further comprises: a first prong, a second prong, a third prong and a fourth prong;

a topper receiver post mechanically coupled to the dome and configured to receive the topper ornament;

a tree post mechanically coupled to the dome and configured to receive the center pole;

a plurality of tree post supports, mechanically coupled to the dome; wherein the plurality of tree post supports further comprises: a first tree post support, a second tree post support, a third tree post support and a fourth tree post support;

wherein the plurality of tree post supports are offset from the plurality of prongs to prevent the plastic deformation.

2. The attachment system of claim 1, wherein the first tree is located at zero degrees; the second tree post support is located at 90 degrees; the third tree post support is located at 180 degrees; the fourth tree post support; is located at 270 degrees; the first prong is located at 45 degrees, the second prong is located at 135 degrees; the third prong is located at 225 degrees; and the fourth prong is located at 315 degrees.

* * * * *